United States Patent [19]

Tammy

[11] 3,943,823

[45] Mar. 16, 1976

[54] CONTROL SYSTEM FOR DOUBLE ACTING AIR MOTOR

[75] Inventor: Simon Z. Tammy, Lorain, Ohio

[73] Assignee: Nordson Corporation, Amherst, Ohio

[22] Filed: June 13, 1974

[21] Appl. No.: 478,977

[52] U.S. Cl. ..... 91/306; 91/313; 91/323

[51] Int. Cl.[2] ..... F01L 25/06; F01L 15/16

[58] Field of Search ..... 91/306, 305, 323, 313

[56] References Cited

UNITED STATES PATENTS

| | | | |
|---|---|---|---|
| 1,084,009 | 1/1914 | Heany | 91/306 |
| 1,161,787 | 11/1915 | Nickol | 91/306 |
| 3,540,348 | 11/1970 | Pennther | 91/306 |
| 3,635,125 | 1/1972 | Rosen | 91/305 |
| 3,771,421 | 11/1973 | Scheffer | 91/306 |
| 3,811,795 | 5/1974 | Olsen | 91/306 |

*Primary Examiner*—Paul E. Maslousky

*Attorney, Agent, or Firm*—Wood, Herron & Evans

[57] ABSTRACT

A system for controlling a reciprocable double acting air motor including a pair of power valves for reversing the inlet and exhaust air to and from opposite sides of the piston in the air motor. The control apparatus includes a pair of snap opening pilot valves which are unseated in response to momentary mechanical engagement with the piston of the air motor and which are then pneumatically shifted open so that the energy to effect the pilot valve shift is derived from the air supply line and not from the air motor piston. The return of the pilot valves to the closed position is in response to pressure reversal in the air motor. The power valves each include a pair of chokes, one of which is continuously operable and is of moderate flow restriction and the other of which is intermittently operable and is of high flow restriction. These chokes cooperate to (1) cause completion or reversal of a shift cycle in the event of a loss of the pilot signal during the shift cycle and to (2) stabilize the valve and prevent bounce back from a seated condition. The control apparatus also includes a poppet type pressure regulating valve with self-aligning poppet seals.

4 Claims, 7 Drawing Figures

| | |
|---|---|
| LEFT SEAT(89) = 1.1800 = 1.0936 $in^2$ | RIGHT SEAT(112) = 0.8560 = 0.5755 $in^2$ |
| LEFT PILOT(69) = 1.0310 = 0.8348 $in^2$ | RIGHT PILOT(120) = 1.0310 = 0.8348 $in^2$ |
| LEFT CHOKE(68) = 1.2500 = 1.2272 $in^2$ | RIGHT CHOKE(111) = 0.7500 = 0.4418 $in^2$ |
| LEFT CHOKE (87-68) DIAMETRAL CLEARANCE = $\frac{0.007''}{0.009}$ | RIGHT CHOKE (88-111) DIAMETRAL CLEARANCE = $\frac{0.001''}{0.003}$ |

LOWER POWER VALVE SPOOL (1) HOLD LEFT (1.1800 SEAT) — 1.1800 − 1.0310 = 0.2588 $in^2$
(2) HOLD LEFT OFF SEAT (1.2500 CHOKE) — 1.2500 − 1.0310 = 0.3924 $in^2$
(3) CRACK RIGHT — 1.0310 − (1.1800 − 1.0310) = 0.5760 $in^2$
(4) SHIFT RIGHT (1.2500 CHOKE) — 1.0310 − (1.2500 − 1.0310) = 0.4424 $in^2$
(5) SHIFT RIGHT (0.7500 CHOKE) — 1.0310 + (1.0310 − 0.7500) = 1.2278 $in^2$
(6) SEAT RIGHT — 1.0310 + (1.0310 − 0.8550) = 1.0941 $in^2$

UPPER POWER VALVE SPOOL (7) HOLD LEFT (0.8560 SEAT) — 1.0310 − 0.8560 = 0.2593 $in^2$
(8) HOLD LEFT OFF SEAT (0.7500 CHOKE) — 1.0310 − 0.7500 = 0.3930 $in^2$
(9) CRACK RIGHT — 1.0310 − (1.0310 − 0.8560) = 0.5755 $in^2$
(10) SHIFT RIGHT (0.7500 CHOKE) — 1.0310 − (1.0310 − 0.7500) = 0.4418 $in^2$
(11) SHIFT RIGHT (1.2500 CHOKE) — 1.0310 + (1.2500 − 1.0310) = 1.2272 $in^2$
(12) SEAT RIGHT — 1.0310 + (1.1800 − 1.0310) = 1.0936 $in^2$

Fig. 6

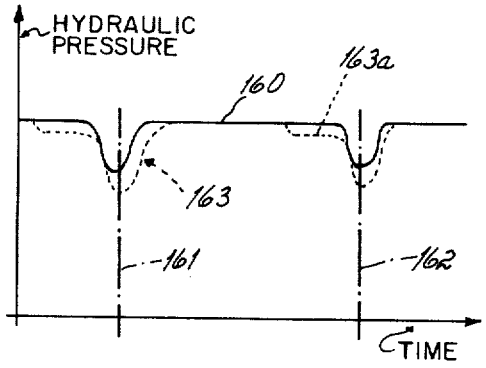

Fig. 7

CONTROL SYSTEM FOR DOUBLE ACTING AIR MOTOR

This invention relates to reciprocating pneumatic motors and particularly to pneumatic motors used for driving double acting liquid pumps.

The invention has particular utility, but is not intended to be limited, to reciprocating pumps and pneumatic motors for driving these pumps for pumping paint in the so called airless method of spray painting. In this spray method, the paint is projected from a small orifice nozzle under high pressure and continuity of even pressure is essential to obtain optimum results. Any departure from even pressure results in an irregular output of paint and this irregularity in turn degrades spray results.

A specific problem in the control of reciprocating pneumatic motors is that of admitting and exhausting air from the pneumatic motor cylinder with a minimum of time delay to effect reversal of the motor piston and with a minimum of motor piston energy absorption to initiate or trigger the reversal. The greater the time delay and the greater the energy absorption from the motor piston required to initiate the reversal, the greater is the loss of motive work done by the piston, and when the piston is used to drive a hydraulic pump, the greater is the decrease or dip in hydraulic outlet pressure. Otherwise expressed, the greater the time between steady state stroking conditions required to effect reversal of the pump driving pneumatic motor, the greater is the hydraullic pressure drop effected by the reversal. Similarly, the greater the mechanical energy taken from the air motor to cause the reversal, the greater is the hydralic pressure loss or drop at the pump outlet caused by the reversal.

Another problem in the control of reciprocating pneumatic motors is that of preventing the control and consequently the motor piston from stalling with the control in a dead-center position, particularly at low motor stroking rates. Prior art reversible pneumatic motor control systems have had the tendency for the control system to stall in a dead-center position, particularly as the seals and control elements become used and worn.

A further problem in the control of reciprocating pneumatic motors when precise output force is required, as for driving paint pumps, is accurate and highly responsive air pressure regulation. Typical diaphragm type regulators previously used for this purpose have been quite large in order to minimize sensitivity to supply pressure fluctuations and yet provides adequate flow capability, whereas more compact poppet type regulators have previously been undesirable due to high cost resulting from difficult construction requirements.

SUMMARY OF THE INVENTION

It has therefore been among the objectives of this invention to provide a very fast acting "closed center" control system for a double acting air motor operable to very quickly reverse the direction of the motor piston at the end of each stroke regardless of stroking rate.

Another objective of this invention has been to provide a control system for a double acting air motor operable to reverse the direction of motor piston movement in response to a minimum pilot signal and with a minimum loss of motor piston energy.

Still another objective has been to provide a control system for a double acting pneumatic motor which is substantially free of any tendency to stall in a dead-center position.

Another objective of this invention has been to provide a control system which includes a pilot valve exposed to the pressure of the control function and which is mechanically unseated, pneumatically shifted, and which returns to a reset position upon the establishment of line pressure in the motor chamber to which it is exposed.

Still another object of this invention has been to provide a compact poppet type pressure regulating valve with self-aligning poppet seals to provide minimum leakage and mechanical friction without requiring highly precise and complex construction.

The apparatus which accomplishes these functions comprises a pair of back to back three-ways valves which function as a four-way direction control valve to control the reversal of regulated air supply and exhaust to opposite ends of a pneumatic motor. The two three-way direction control valves include pairs of chokes, one of which is continuously operable and is of moderate flow restriction and the other of which is intermittently operable and is of high flow restriction.

One very important aspect of this invention is predicated upon the concept of utilizing a pair of chokes in each of the direction control valves, one of which chokes is continuously operable and is of moderate flow restriction and the other of which is intermittently operable and is of high flow restriction. These two chokes are so sized and located that they cooperate to effect:

1. completion or reversal of a shift cycle by the valve spool in the event of loss of the pilot signal during the shift, and
2. stabilization of the valve spool and the elimination of bounce back of the spool from a seated condition.

Movement of the direction control valves is controlled by a pair of pilot valves, each of which is exposed to the pressure in one end of the pneumatic motor. The pilot valves are held in a seated condition by a contamination of spring and pneumatic forces and are unseated in response to momentary mechanical engagement with the piston of the air motor. When mechanically unseated by the motor piston, the pilots are pneumatically snap shifted by air pressure from the air supply line. The pilots are then spring returned to a reset position in response to the reversal of pressures in the motor.

Another aspect of this invention is predicated upon this concept of pilot valves which are exposed to the pressure of the control function, i.e., the motor chamber pressure, and which are mechanically unseated, pneumatically snap shifted and momentarily latched open by line pressure, and which return to the reset position upon the establishment of line pressure in the motor piston chamber. One advantage of this pilot valve construction is that it is mechanically started and pneumatically shifted so that the shifting energy is derived from the air line and not from the motor piston. Consequently, this construction eliminates air motor piston energy dips or hydraulic output pressure dips heretofore required to store the energy necessary to effect subsequent snap actuation of the pilot valve.

A characteristic of this control system is that it utilizes a pneumatically actuated momentary pilot signal together with a pneumatically latched direction control. Prior to this invention the practice was generally to utilize a mechanically actuated continuous pilot signal with a non-latching direction control as in U.S. Pat. No. 3,635,125 of S. R. Rosen et al. That mechanically actuated continuous pilot, non-latching direction control system required the energy to actuate the pilots to be stored in a pair of springs and it further required that the work to compress the springs be derived from the air motor piston. Consequently, storage of that energy resulted in a dip in the available work derivable from the air motor piston, and, since the piston was used to drive a hydraulic pump, it resulted in a hydraulic pressure dip at the pump outlet.

Another advantage of this particular control with its momentary pilot signal and latching direction control feature is that it eliminates the need to connect the pilots together either mechanically or pneumatically. Consequently, response rate and reliability are improved, failure analysis is simplified, and it is easier to repair the valves.

These and other objects and advantages of this invention will be more readily apparent from the following description of the drawings in which:

FIG. 3 is a view similar to FIG. 2 but illustrating the control system in a third stage of shift cycle.

FIG. 6 is a chart of the shift cycle of one preferred embodiment of directional control valve incorporating the invention of this application.

FIG. 7 is a comparative plot of hydraulic pressure versus time of a liquid pumping system both with and without the invention of this application.

Figure 1:
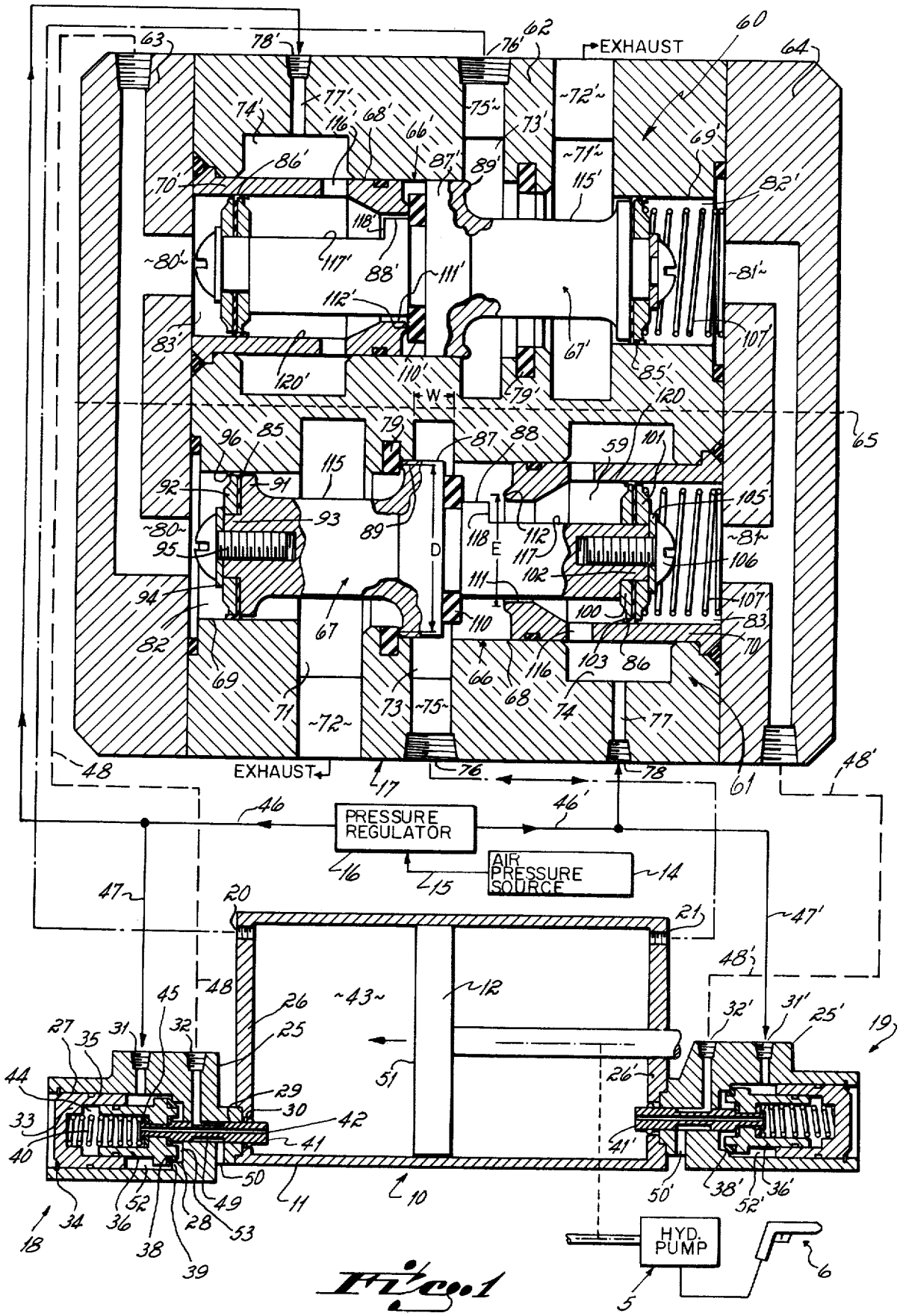
FIG. 1 is a partially diagrammatic cross sectional view of a pneumatic motor and control system incorporating the invention of this application.

Referring to the drawings, and particularly to FIG. 1, there is shown a pumping system which incorporates the invention pneumatic control system of the application. That pumping system includes a double acting pneumatic motor 10 operable to drive a conventional double acting hydraulic pump 5. In one preferred application of this invention the double acting hydraulic pump is operable to pressurize and supply liquid paint to a spray gun 6. A complete description of such a pumping system, including a gun, a double acting hydraulic pump, and a pneumatic motor for driving the pump is contained in U.S. Pat. No. 3,635,125. For purposes of illustrating and describing that portion of the system, that patent is hereby incorporated by reference.

In the system of FIG. 1, air pressure for operating the motor 10 is supplied from an air pressure supply 14 through a pressure line 15 to a pressure regulator 16. From the pressure regulator the air at regulated pressure is supplied through a directional control valve 17 to one end of the motor cylinder 11 while air is simultaneously exhausted through the directional control valve from the opposite end of the motor cylinder. The reversal of the directional control valve 17 is controlled by a pair of pilot valves 18 and 19, bolted or otherwise fixedly secured to the opposite ends of the cylinder of the motor 10. When actuated by the piston 12 of the motor, these pilot valves in cooperation with the directional control valve 17 are operative to effect a reversal of the pressure and exhaust air flow to the opposite ends of the motor through the motor ports 20, 21.

Pilot Valves

The two pilot valves 18 and 19 are identical and, therefore, only one, 18, will be described in detail. In order to distinguish the corresponding components of the pilot valve 19, each has been given the same numerical designation as the corresponding component of pilot valve 18 but followed by a prime mark.

The pilot valve 18 comprises a valve body 25, bolted or otherwise fixedly secured to end wall 26 of the air motor 10. This valve body is bored so as to define coaxial bores 27 and 29 interconnected by a stepped bore 28 of intermediate diameter. The smaller diameter bore 29 of the valve body is coaxial with an aperture 30 in the end wall 26 of the motor 10. An air pressure supply port 31 of the valve body opens into and is in fluid communication with the large diameter bore section 27 of the body and a pilot signal port 32 of the valve is in fluid communication with the small diameter bore 29 of the body. A closed end valve sleeve 33 is mounted within the large diameter bore 27 of the body 25 and is secured therein by a snap ring 34. Slidable within a cylinder bore 35 of the sleeve is a generally cup shaped piston 36, the closed end of which contains a molded-in resilient valve seat 38. The valve seat 38 cooperates with a shoulder 39 of the valve body to separate chamber 52 from chamber 53 in the closed condition of the pilot valve. A spring 40 is operable between the sleeve 33 and the piston 36 to bias the piston 36 to the closed condition. The sealing diameter 39 is larger than the sealing diameter 35 so that the air pressure in chamber 52 acts in conjunction with spring 40 to hold the valve seat 38 against the shoulder 39 in the closed condition. Extending outwardly from the piston 36 through the bore 29 of the valve body and the aperture 30 in the end wall 26 into the interior chamber 43 of the pneumatic motor 10 is a ported piston rod 41. This rod has an axial passage 42 which connects the chamber 43 of the motor 10 to the cylinder chamber 44 of the pilot valve so that the pressure interiorly of the pilot valve cylinder chamber 44 is the same as the pressure interiorly of the air motor chamber 43. The clearance between the bore 29 and the rod 41 adjacent to chamber 53 is small but sufficient to maintain the pressure in chamber 53 essentially equal to that in the groove 49 when the valve seat 38 is in contact with the shoulder 39 in the closed condition. In that condition the groove 49 is in communication with the exhaust port 50, resulting in essentially atmospheric pressure in chamber 53. The piston rod 41 is fixedly secured to the piston 36 by riveting or similar means at 45 so that the piston and piston rod move in unison. Alternately, the rod 41 and the piston 36 may be formed as a single integral part.

In operation, the supply pot 31 of the pilot valve is connected to the pressure regulator by pneumatic supply lines 46, 47 and the pilot signal port 32 is connected to the pilot signal ports of the directional control valve 17 by air line 48. In the condition of the pilot valve depicted in FIG. 1, the pilot signal line 48 of the valve 18 is connected to the exhaust port 50 by the annular groove 49 in the periphery of the piston rod 41. When the motor piston 12, though, reaches the leftwardmost end of its motion, its top surface 51 contacts the end surface of the rod 41 and causes the rod to be moved leftwardly, thereby displacing the valve seat 38 from sealing engagement with the shoulder 39. This has the effect of connecting the pilot valve chamber 52 to the chamber 53, thereby applying high pressure to the major inner end area of the piston 36. This high air pressure then rapidly snaps the piston 36 leftward, overcoming the bias of the spring 40 until the piston reaches the leftwardmost extent of its motion and momentarily latches the piston in that position. In this leftwardmost position of the piston 36, the groove 49 of the piston rod 41 and the chambers 52, 53 connect the air pressure supply port 31 of the pilot valve to the pilot signal port 32 and the outer portion of the rod 41 closes off the exhaust port 50, with the result that air at regulated system pressure is supplied from the line 47 through the pilot valve 18 to the pilot signal ports of the directional control valve 17. The small clearance between the rod 41 and the bore 29 intermediate the groove 49 and the piston 36 establishes an intermittent restrictive choke 41–29 to prevent substantial interconnection between the supply port 31 and the exhaust port 50 during the initial opening motion of the pilot valve, thereby providing a "closed center" shift characteristic. The work to open the pilot valve is thus essentially provided by the supply line air pressure rather than by mechanical energy taken from the motor piston 12.

Resetting of the pilot valve is accomplished by air at high pressure entering the motor chamber 43 as a result of shifting the direction control valve 17. This high pressure air is communicated to the cylinder chamber 44 of the pilot valve through the axial passage 42 of the piston rod 41, placing all pressure forces on the pilot valve in balance. As the motor piston 12 then moves rightward out of contact with the rod 41, the spring 41 causes the pilot valve piston 36 to move to the right thereby extending the rod 41 into the chamber 43 and resetting the valve seat 38 against the shoulder 39. The work to reset the pilot valve is thus provided from energy previously stored in the spring 40 by the regulated system air pressure during the opening of the valve.

Directional Control Valve

The directional control valve 17 functions to control inlet and exhaust air flow from the respective end ports 20, 21 of the air motor 10. Structurally, it consists of a pair of three-way valves mounted back to back and functionally operable as a four-way directional control valve to control the inlet and exhaust of air from the motor cylinder 11. The two three-way directional control valves or so called "power valves" 60, 61 are identical and are mounted in a common valve body 62 having identical end plates 63, 64. The only difference is that they are reversed end for end within the valve body and biased leftward or in the same direction by springs 107, 107″. Since the two are identical, only one, the lowermost one illustrated in FIG. 1, will be described in detail. The identical parts of the two valves 60, 61 will be given the same numerals except that the numerals for the corresponding parts in the upper valve are followed by a prime mark. For the sake of clarity, the two valves are divided within the housing by the dashed line 65. Further, the pressure regulator 16 and also the supply lines 46 and 46′ are schematically shown as external elements although they may be and are in a preferred embodiment contained within the valve body 62.

The valve body 62 has a stepped bore 66 therein within which a valve spool 67 is slidable. The bore 66 is divided into a large diameter section 68 and a smaller diameter section 69. Extending radially outwardly from the small diameter bore 69 there is an exhaust channel 71 which is connected by an exhaust passage 72 to the exterior of the valve body. A pair of channels, one a control channel 73, and the other a supply pressure channel 74, extend outwardly from the larger diameter section 68 of the bore 66. The control channel 73 is connected by a passage 75 to a control port 76 of the valve. The supply channel 74 is connected by a passage 77 to the supply port 78 of the valve. The shoulder between the stepped sections of the bore 66 is defined by a resilient seal 79, which, as explained more fully hereinafter, cooperates with a rounded protrusion or torus of the valve spool to form a seal between the exhaust channel and the control channel of the valve. A valve sleeve 70 is mounted within the large diameter section 68 of the bore. This sleeve is ported by apertures 116 so that its interior chamber 59 is open to the air pressure supply channel 74.

There are two pilot signal ports 80, 81 which extend into the opposite end plates and are in fluid communication with the opposite end chambers 82, 83 of the power valve 61. These ports 80, 81 are connected by the pneumatic lines 48 and 48′ respectively to the pilot signal ports 32, 32′ of the pilot valves.

The power valve spool 67 comprises a pair of piston ends 85, 86, between which there are two lands 87, 88. The larger of these two lands 87 is slidable within the large diameter bore 68 with which it forms a choke 87–68 of moderate restriction. It has a protrusion or torus 89 formed on its radial surface which is engageable with the valve seat 79 to form a seal between the exhaust channel and the control channel of the power valve. The larger diameter land 87 is of a width greater than the width W of the control channel 73 so that in passing across the control channel it blocks the channel. Consequently, the large diameter land 87 continuously forms a restrictive barrier between the high pressure supply channel 74 of the valve and the low pressure exhaust channel 71 irrespective of the position of the large diameter land within the bore 68, thereby providing a "closed center" shift characteristic.

The small diameter land 88 is located adjacent the large diameter land 87, but is separated from it by a resilient valve seat 110 mounted within an annular groove of the spool 67. A protrusion or torus 112 formed on the inner radial face of the valve sleeve 70 is engageable with the valve seat 110 to form a seal between the supply pressure channel 74 and the control channel 73 of the power valve. The land 88 is cooperable with the smaller bore 111 of the valve sleeve 70 to form a tightly restricted choke 88–111 between the two when they are in axial alignment. A flow passage is provided between the face 118 of the land 88 and the piston end 86 by a triangular section 117 in the spool 67. The outermost extent of this triangular section forms three guide ribs continuous with the periphery of the land 88 to guide the land through the bore 111. As explained more fully hereinafter, this tightly restricted choke 88–111 is intermittently operable during the stroke of the spool 67 and is cooperable with the moderate choke 87–68 to expedite the shifting movement of the spool within the valve body.

In one preferred embodiment, the clearance between the land 88 and the bore 111 of the sleeve 70 is approximately 0.002 inches when the two elements are axially aligned and the clearance between the land 87 and the bore 68 is approximately 0.008 inches. As explained more fully hereinafter, this larger clearance between the large diameter land and associated bore 68 and the relatively smaller clearance between the land 88 and its associated control bore 111 are essential to the operation of the system.

The end piston 85 of the spool 67 operable within the bore 69 comprises an enlarged diameter end section 91 of the spool, a disk 92 secured over an end hub 93 of the spool by a washer 94 and machine screw 95 and a cup seal 96 contained between the disk 92 and the end section 91.

The piston 86 on the opposite end of the valve spool operable within the bore 120 is formed by a pair of disks 100, 101 mounted over a generally hub shaped end section 102. A cup seal 103 is contained between the two disks 100, 101 which are secured on the end of the hub by a washer 105 and a machine screw 106. The disks 92, 100, 101 are identical as are the seals 96, 103 and the retaining washers 94, 105 and screws 95, 106.

The compression spring 107 is located within the bore 120 of the sleeve 70 and has one end bearing against the inside edge of the plate 64 and the opposite end bearing against the outer end of piston 86. This spring functions to bias the valve spool to the leftwardmost position, the position illustrated in FIG. 1. The purpose of this bias is to establish a predetermined consistent position for the spools 67, 67' when the air pressure supply is removed.

The exhaust channel 71 of the valve is selectively connectable to the control means 73 by a groove 115 in the periphery of the valve spool 67. When the valve spool is moved to the right to a position in which the control channel 73 is open to the groove 115, the exhaust channel 71 is operatively connected to control channel 73. Alternately, when the valve spool is in its leftwardmost position as depicted in FIG. 1, the air pressure supply channel 74 is connected to the control channel 73 by the radial apertures 116 in the valve sleeve 70 and the longitudinal flats 117 on the surface of the spool 67.

Operation of Control System

The control system of FIG. 1 can best be explained with reference to FIGS. 1–4 and with reference to the chart of FIG. 6. This chart incorporates at its heading dimensions for several sections of a preferred embodiment of the power valve 61. These dimensions are not absolute for the concept of the power valve, but the relative sizes and clearances are fundamental to an understanding of the operation of the power valve. Accordingly, they have been incorpoated into the chart and into an explanation of the operation of the system.

Figure 2:
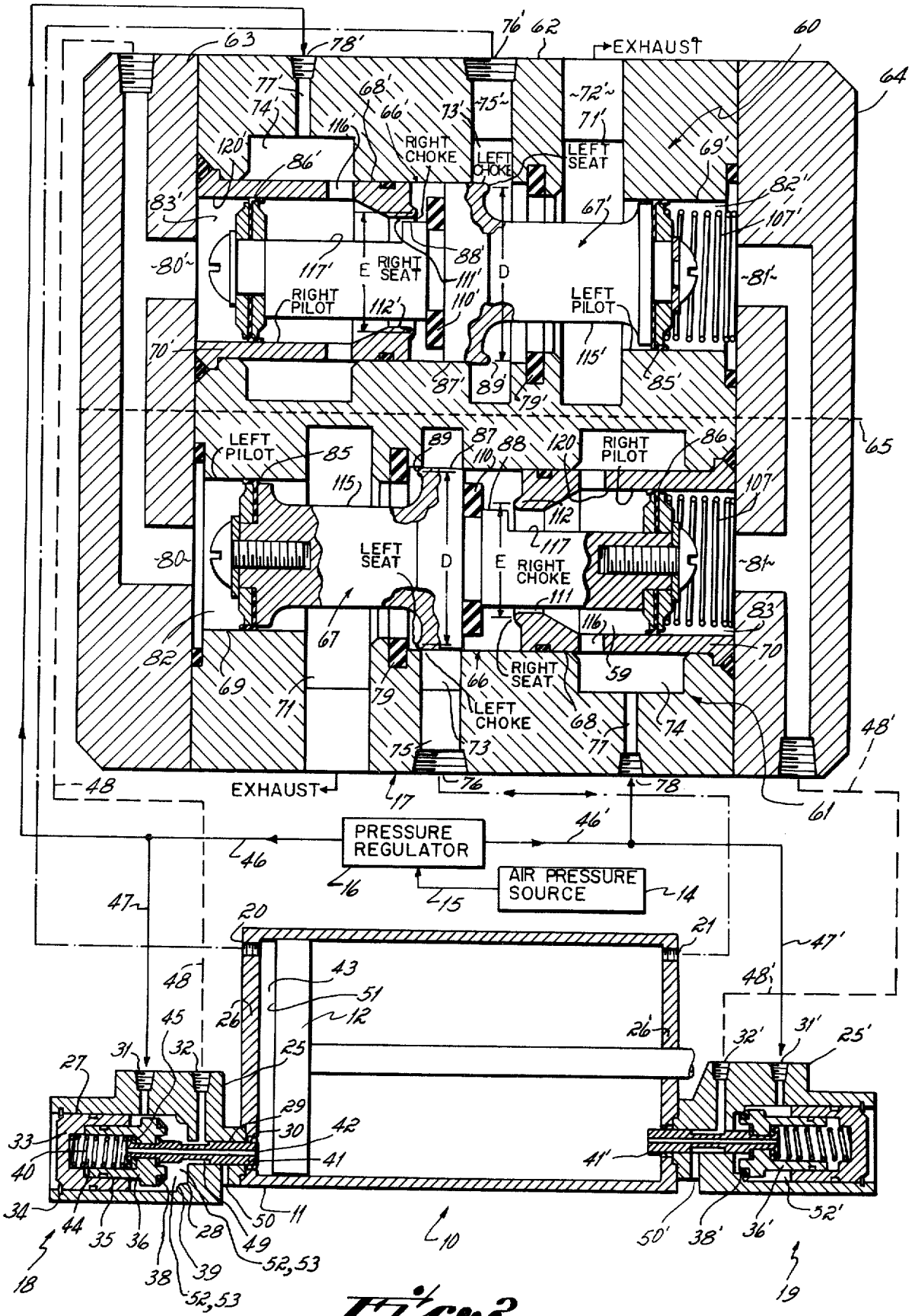
FIG. 2 is a view similar to FIG. 1 but illustrating the control system in a second stage of shift cycle.

Referring first to the chart (FIG. 6) and to FIG. 2, it will be seen that in the preferred embodiment, the left seat protrusion 89 has an effective diameter D at the point at which it contacts the seat 79 of 1.180 inches and that diameter circumscribes an area of 1.0936 inches$^2$. The diameter of the bore 69, referred to as the left pilot, and so labeled in FIG. 2, is 1.031 inches and it circumscribes an area of 0.8348 inches$^2$. It will further be seen that in the preferred embodiment the diameter of the bore 68, referred to as the left choke and so labeled in FIG. 2, is 1.250 inches which encompasses an area of 1.2272 inches$^2$. The clearance of the left choke between the land 87 and the bore 68 is between 0.007 and 0.009 inches.

In this preferred embodiment, the effective diameter E of the right seat protrusion 112 is 0.856 inches and this diameter circumscribes an area of 0.5755 inches$^2$. The diameter of the inside bore 120 of the sleeve 70, referred to as the right pilot and so labeled in FIG. 2, is 1.031 inches which encompasses an area of 0.8348 inches$^2$. The diameter of the small bore 111 in this preferred embodiment, referred to as the right choke, is 0.750 inches and this circumscribes an area of 0.4418 inches$^2$. The clearance of the right choke between the land 88 and the bore 111 is between 0.001 and 0.003 inches.

Startup

The control system is shown in a startup position in FIG. 1. In this startup position, both of the power valve spools 67, 67' are in their leftwardmost position as determined by the bias of the springs 107, 107''. In this leftwardmost position of the power valves, the regulated supply pressure is connected by the spool 67 to the control power 76 which is in turn connected to the motor inlet port 21. Simultaneously, the opposite port 20 of the pneumatic motor 10 is connected to the control port 76' which is in turn connected by the spool 67' to the exhaust channel 71' and exhaust passage 72''. Consequently, the motor piston 12 is urged at startup to the left as viewed in FIG. 1.

At startup, the two pilot valves are also in the condition illustrated in FIG. 1. The valves are supplied with air at regulated supply pressure via the lines 47, 47', but that air remains entrapped within the chambers 52, 52' because of the pilot valves being in a closed position.

At startup and until the condition of the control circuit is changed by contact of the motor piston 12 with the rod 41 of the pilot valve 18, the net effect of the supply air pressure acting on the spools 67, 67' is to maintain them latched in their leftwardmost seated position.

Lower Power Valve Spool Hold Left on Seat

With reference to FIG. 1 and line 1 of the chart of FIG. 6, it will be seen that the lower power valve spool 67 is held left while the piston 12 moves leftwardly by the high pressure air in the supply channel 74 acting against the right surface of the large land 87. As mentioned hereinabove, there is a moderate clearance between the large land 87 and the bore 68 so that the high pressure air effectively operates over the area encompassed by the diameter D when the spool 67 is in the left seated condition. That area is the area circumscribed by the point of contact of the torus 89 with the seal 79. Simultaneously, there is an oppositely directed force generated by the high supply pressure acting against the piston 86 to urge the spool in a rightward direction. The net force, though, because the area encompassed by the diameter D of the large land is greater than the area encompassed by the piston 86, urges the spool to the left with a force proportional to this difference in area. In the example that net difference in area is 0.2588 inches$^2$. Otherwise expressed, that difference in area, 0.2588 inches$^2$ times the pressure in the supply channel 74 is operative to hold the spool in its leftwardmost position. This condition corresponds to the upper power valve spool hold condition shown in FIG. 4.

Lower Power Valve Spool Hold Left Off Seat

If the lower valve spool 67 should move rightwardly to a position in which the torus 89 of land 87 is unseated from the seal 79 as in FIG. 2, or if the seal 79 should fail, either because of wear or because of the presence of foreign matter preventing an effective seal, the net force tending to urge the piston leftwardly is increased so as to more strongly urge the spool 67 toward the seated condition. This increase occurs because as soon as the land 87 moves to an unseated condition relative to the seal 79, the left radical face of the land 87 is in communication with air at atmospheric pressure. In this condition, the effective area of the land 87 to which high pressure is exposed is the complete diameter of the land or so called "left choke" area, rather than the diameter of the circle encompassed by the point of contact of the protrusion 89 with the seal 79. Consequently, the net force urging the spool 67 leftwardy in this hold left off seat condition is proportional to the area encompassed by the peripheral diameter of the land 87 less the area encompassed by the diameter of the piston 86, or 0.3924 inches$^2$ in the example depicted in the chart of FIG. 7. This condition corresponds to the upper power valve spool hold condition shown in FIG. 3.

Upper Power Valve Spool Hold Left on Seat

Referring to FIG. 1 and line 7 of the FIG. 6 chart, there is depicted the condition which obtains to hold the upper power valve spool in the leftwardmost position at startup and during the stroke of the piston 12 from the right to the lefthand side of the cylinder. In this leftwardmost position of the spool 67', high pressure air in the supply channel 74' is operative over the area of the piston 86' to urge the spool in the leftward direction while simultaneously that same pressue is operative over the area of the seal between the protrusion 112' and the seat 110' to urge the spool 67' rightwardly. The net effect of that air pressure is to hold the spool 67' in the leftwardmost position with a force proportional to the difference in area between the right pilot and the area encompassed by the right seat, or 0.2593 inches$^2$ in the preferred embodiment. This condition corresponds to the lower power valve spool hold condition shown in FIG. 4.

Upper Power Valve Spool Hold Left Off Seat

The condition which obtains when the upper power valve 67' moves to the right off of the right seat or when the seal between the protrusion 112' on the sleeve and the valve seat 110' is broken is depicted in FIG. 2 and line 8 of the FIG. 6 chart. When this seal is broken or as when the upper spool 67' moves slightly to the right, the net force tending to move the spool 67' back to the left increases from the hold left condition. This increase is effected because of the presence of the right choke or tight diametral clearance between the bore 111' of the sleeve and the peripheral surface of the land 88'. Since the right choke is substantially more restrictive than the left choke between the land 87' and the bore 68', when the right choke is engaged and the spool 67' is off the right seat the pressure between the two chokes is essentially atmospheric. Therefore, as the seat 110' moves out of contact with the protrusion 112', the area of the spool 67' exposed to the high pressure effectively decreases to the area of the land 88' rather than the area enclosed within the line of contact between the protrusion 112' and the valve seat 110'. That decrease of effective area exposed to the high pressure air diminishes the net area exposed to a rightward force so that the net force which urges the spool 67' to the left increases and becomes proportional to the differential in area between the right pilot and the right choke, or 0.3930 inches$^2$ in the example. This condition corresponds to the lower power valve spool hold condition shown in FIG. 3.

Lower Power Valve Spool Crack Right

As soon as the air motor piston 12 contacts the rod 41 of the pilot valve, the motor piston 12 causes the rod and pilot valve piston 36 to move inwardly and unseat the pilot valve. As soon as this unseating of the pilot valve occurs, high pressure air is dumped from the chamber 52 of the pilot valve to the underside of the pilot valve piston 36. This causes the piston 36 and rod 41 to move inwardly in a snap action, thereby connecting the high pressure air chambers 52, 53 to the pilot signal port 32 of the pilot valve through the groove 49 of the rod 41. This high pressure pilot signal from the pilot valve is then transmitted via lines 48 to the pilot signal ports 80, 80' of the directional control valve 17.

Upon the high pressure pilot signal arrival at the ports 80, 80' of the directional control valve, both spools 67, 67' initiate movement toward the right as viewed in FIG. 1. The two spools then move in parallel and essentially in unison toward the rightwardmost position.

The force tending to move the lower spool 67 off of its leftwardmost seated position is then a function of the areas of the spool 67 exposed to high pressure. That force is shown in line 3 of FIG. 6 as proportional to the area of the left pilot minus the difference in area between the left seat and the right pilot, or a net 0.5760 inches$^2$ in the example. This net force is sufficient to overcome the bias of the spring 107 and initiates rightward movement of the lower spool 67. This condition corresponds to the upper power valve spool cracking condition shown in FIG. 4.

Lower Power Valve Spool Shift Right

As soon as the protrusion 89 of the lower spool moves out of engagement with the valve seat 79, the complete left side of the land 87 is exposed to the exhaust channel with the result that the effective area of the land exposed to high pressure from the supply channel 74 is the complete area of the land or so-called left choke area. This is the condition illustrated in FIG. 2 of the drawings. Consequently, the force tending to move the spool from the cracked condition and to shift it to the right after disengagement of the protrusion 89 from the seat 79 is proportional as in line 4 of FIG. 6 to the area of the left pilot minus the difference in area between the left choke and the right pilot, or 0.4424 inches$^2$ in the example. This condition corresponds to the upper power valve spool shift condition shown in FIG. 3.

Referring to the line 5 of FIG. 6 and FIG. 3 of the drawings, the condition is charted and illustrated which obtains when the small land 88 enters the bore 111 forming the more restrictive choke 88–111. When this occurs, the net effect is to substantially increase the force tending to move the spool 67 rightward. Upon entrance of the land 88 into the bore 111 the more restrictive choke 88–111 overcomes the less restrictive choke 87–68 and serves as the barrier between the high pressure supply channel 74 and the exhaust channel 71. In this condition the force tending to continue the rightward movement of the spool 67 is proportional to the area of the left pilot plus the difference in area between the right pilot and the right choke or 1.2278 inches$^2$ in the example. This force then acts on the spool 67 and carries it rightward until it reaches the right seated condition in which the seat 110 is engaged with the protrusion 112 of the valve sleeve 70. This condition corresponds to the upper power valve spool shift condition shown in FIG. 2.

It is to be noted that even if the pilot signal to the port 80 were lost after the land 88 reached the bore 111, the net force derived from the high air pressure in the chamber 74 acting on the difference in area between the right pilot and the right choke would cause the spool 67 to complete its shift cycle. Alternatively, if the pilot signal were lost before the land 88 reached the bore 111, the net force derived from the high air pressure in the chamber 74 acting on the difference in area between the left choke and the right pilot would return the spool 67 to its starting position.

Lower Power Valve Spool Seat Right

Figure 4:
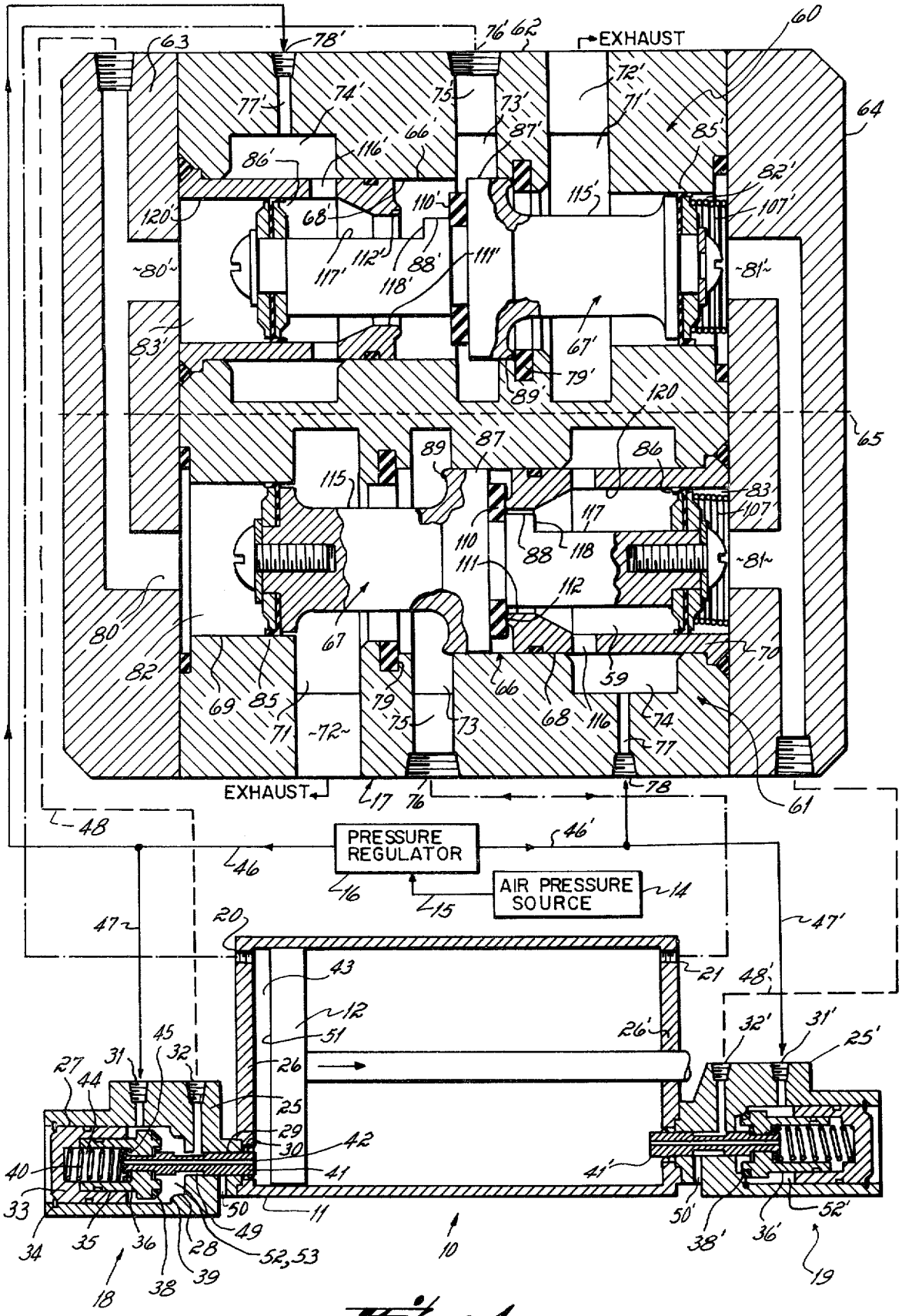
FIG. 4 is a view similar to FIG. 2 but illustrating the control system in a fully shifted position.
Figure 5:
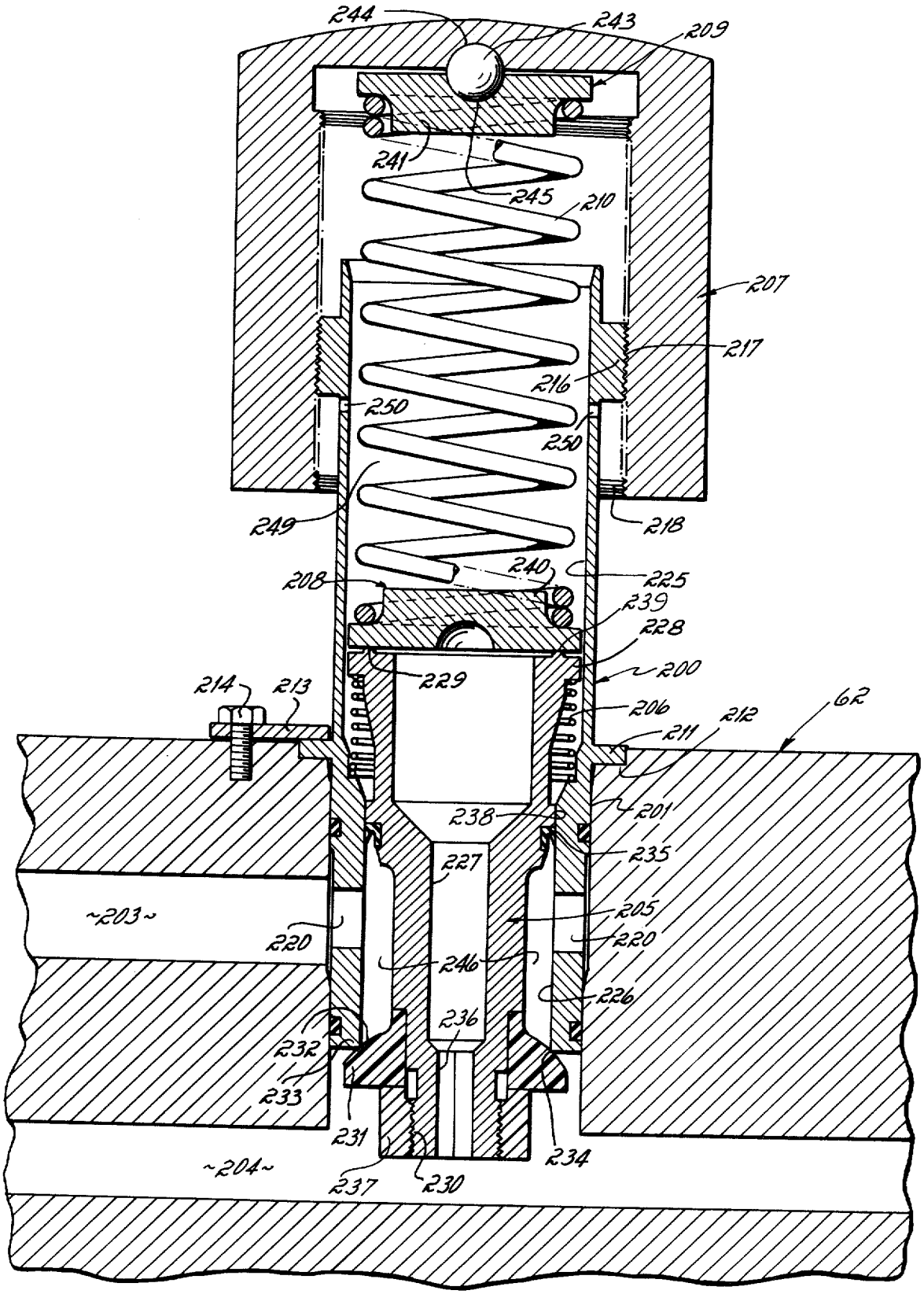

The condition which obtains when the lower spool reaches its rightwardmost seated condition is depicted in FIG. 4 and in line 6 of FIG. 6. When the spool 67 reaches the rightwardmost seated position under pilot pressure, the net force between the seat 110 and the protrusion 112 is proportional to the area of the left pilot plus the difference in area between the right pilot and the right seat, or 1.0941 inches$^2$ in the example. This condition corresponds to the upper power valve spool seating condition shown in FIG. 1.

Upper Power Valve Spool Crack Right

Referring back to FIG. 1, there is illustrated the condition of the upper spool 67' when the high pressure pilot signal arrives at the pilot signal port 80' of the upper power valve 60. With reference to line 9 of FIG. 6 it will be seen that the force then tending to move the spool 67' of the power valve 60 rightwardly is proportional to the area of the right pilot less the difference in area between the right pilot and the right choke. Otherwise expressed, high pressure fluid contained in the chamber on the left side of the piston 86' tends to move the spool 67' rightwardly with a force which is proportional to the area of the piston while at the same time the pressure contained in the chamber to the right of the piston 86' tends to move the piston to the left with a force which is proportional to the difference in area between the right pilot and the right choke, or 0.5755 inches$^2$ in the example. This condition corresponds to the lower power valve spool cracking condition shown in FIG. 4.

Upper Power Valve Spool Shift Right

As soon as the spool 67' moves slightly to the right, the condition illustrated in FIG. 2 and described mathematically in line 10 of FIG. 6 is effected. At that time the force tending to continue the rightward shift of the spool 67' is proportional to the area of the right pilot less the difference in area between the right pilot and the right choke, or 0.4418 inches$^2$ in the example. This condition corresponds to the lower power valve spool shift condition shown in FIG. 3.

As the upper spool 67' continues to move to the right, the smaller land 88' moves to the position of FIG. 3 in which it is clear of the bored 111'. At this point, the force tending to move the spool 67' to the right becomes proportional to the area of the right pilot plus the difference in area between the left choke and the right pilot, or 1.2272 inches$^2$ in the example of line 11 of FIG. 6. This condition corresponds to the lower power valve spool shift condition shown in FIG. 2.

It is to be noted that even if the pilot signal to the port 80' were lost after the land 88' left the bore 111', the net force derived from the high air pressure in the chamber 74' acting on the difference in area between the left choke and the right pilot would cause the spool 67' to complete its shift cycle. Alternatively, if the pilot signal were lost before the land 88' left the bore 111', the net force derived from the high air pressure in the chamber 74' acting on the difference in area between the right pilot and the right choke would return the spool 67' to its starting position.

Upper Power Valve Spool Seat Right

When the upper spool 67' reaches its rightwardmost seated condition under pilot pressure, as illustrated in FIG. 4, the net force between the seat 79' and the protrusion 89' is proportional to the area of the right pilot, plus the difference in area between the left seat and the right pilot, or 1.0936 inches$^2$ in the example of line 12 of FIG. 6. This condition corresponds to the lower power valve spool seating condition shown in FIG. 1.

Reverse Direction Shift of Power Valves

The two power valves then remain in the position illustrated in FIG. 4 throughout the shift cycle of the air motor piston 12 until the motor piston contacts the rod 41' of the pilot valve 19. At that point, the pilot valve shifts and the high pressure signal is transmitted through the pilot valve and line 48' to the pilot signal ports 81, 81' of the direction control valve 17. The two power valve spools 67, 67' then shift leftwardly in the same manner that the two shifted rightwardly, except the forces tending to move the lower spool to the left are the same as had formerly been applied to the upper spool to effect its rightward movement and vice versa. In other words, because of the end for end reversal of the two spools within the valve body, the forces tending to effect the movement of one spool in the reverse direction are exactly the same forces as previously applied to effect the movement of the other spool in the first direction.

It can also be seen from the preferred embodiment quantitatively defined in FIG. 6 that the area versus position relationships are such as to cause the spools 67, 67' to shift essentially in unison even though they are in opposed orientation with respect to the concurrent motions.

Effects of the Dual Chokes in the Operational Sequence

It is to be noted that in the course of shifting to the right the upper power valve spool 67' reaches a position as soon as the small land 88 emerges from the bore 111' in which the upper power valve will complete its shift cycle even if the pilot signal to the port 80' is lost. At that point, the net force created by the high pressure air supply in the valve markedly increases toward a rightward seated position. Similarly, in shifting to the right, the lower spool 67 reaches a position when the small land 88 enters the bore 111 from which it will complete its shift cycle even if the pilot signal to the port 80 is lost. This change between the engaged and disengaged conditions of the land 88 occurs at the mid-point of the shift cycle.

From this explanation of the operational sequence of the two power valves, it will be appreciated that the dual chokes, one of which (the left choke) is less restrictive but is continuously operable in the shift cycle and the other of which (the right choke) is more restrictive but is only intermittently operable in the shift cycle, cooperate to achieve a twofold effect; that is they cooperate to:

1. avoid the power valve spools becoming stalled in an intermediate position by causing the shift cycle to be completed in the event of a loss of the pilot signal to the power valves after the mid-point of the shift cycle or to be reversed to the starting position in the event of a loss of pilot signal prior to the mid-point of the shift cycle.

2. cause the power valve spools to have stability when seated in either a hold left or hold right position because the net force holding them seated increases as soon as they move off the seat. This stability is illustrated by a comparison of lines 1 and 2 of the chart of FIG. 6 and by a comparison of lines 7 and 8 of FIG. 6.

It can be seen that the stability of shift and seating plus the "closed center" characteristic provided by the power valve chokes in combination with the pneumatically shifted "closed center" pilot valves which are latched open until motor pressure is established constitute a valve system of substantial redundancy and therefore of high reliability. At the same time, the elements comprising this system are quite simple, do not demand great precision in their manufacture and can tolerate significant wear without interrupting the system function.

A primary functional advantage of the control system depicted in FIG. 1 is illustrated graphically in FIG. 7. In this figure, time is plotted along the abscissa and hydraulic pressure derived from the hydraulic pump 5 is plotted along the ordinate. The solid line 160 indicates the hydraulic pressure at the outlet side of a double acting hydraulic pump 5 actuated by the air motor 10 and controlled by the control system of FIG. 1. Each time the air motor 10 reverses direction as at the points 161, 162, there is a slight dip in the hydraulic pressure at the outlet of the pump 5. This dip though is much smaller than has heretofore been achievable with conventional prior art control systems, as, for example, that disclosed in U.S. Pat. No. 3,635,125. The output pressure derivable from a control system such as that illustrated in U.S. Pat. No. 3,635,125 is illustrated by the dashed line 163 of FIG. 7. It is to be noted that there is a predip **163*a* in the dashed line 163.** This predip is caused by the extraction of motor piston energy to compress or cock the pilot valve control springs which are subsequently utilized to effect the reversal of the pilot valves. The practice of this invention not only reduces the depth of the pressure dip, but it also completely eliminates the predip which previously had occurred immediately prior to a stroke reversal.

Pressure Regulator

Figure 5:
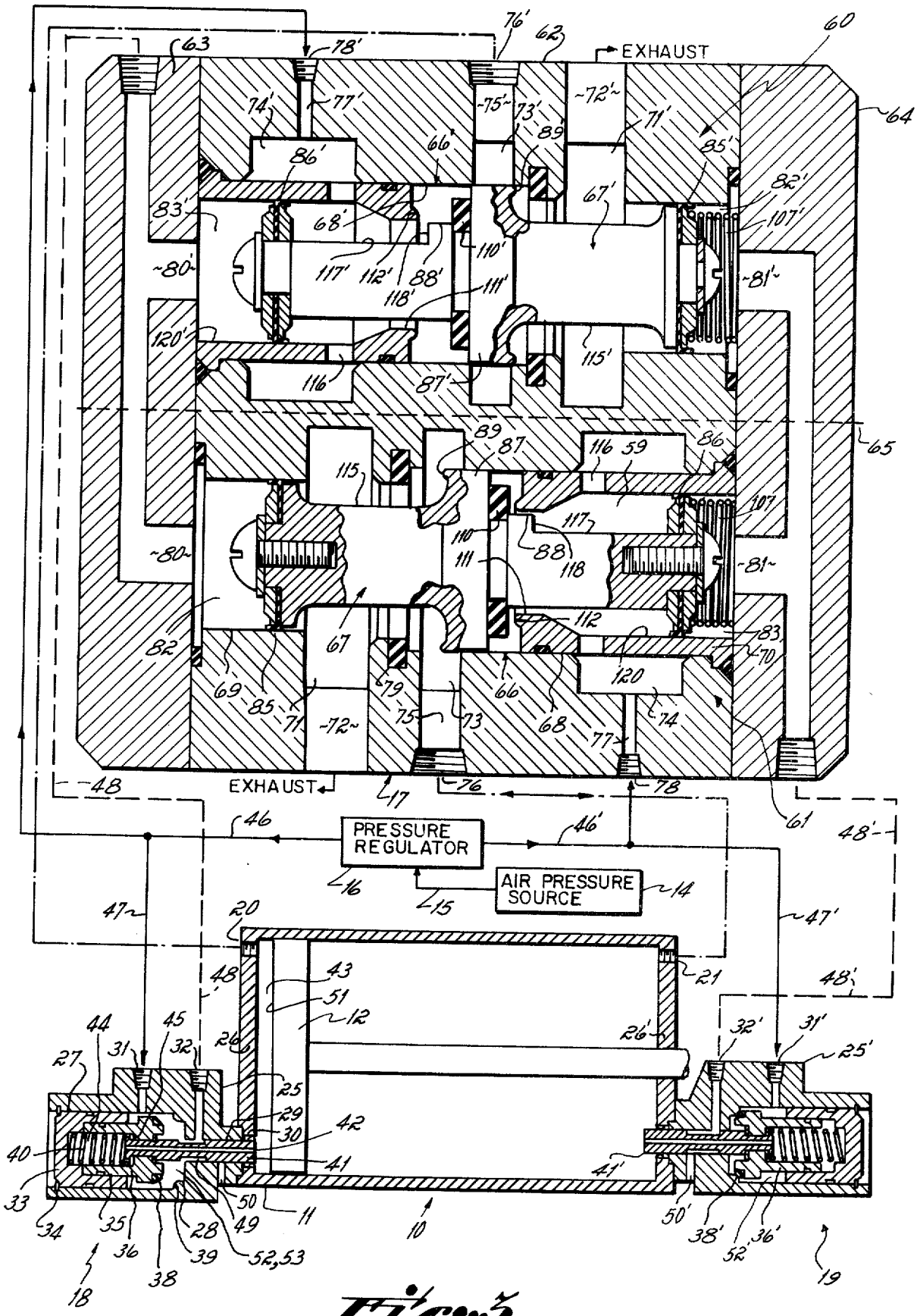
FIG. 5 is a cross sectional view of a pressure regulator valve used in the system of FIG. 1.

The pressure regulator 16 employed in the embodiment of FIG. 1 may be a conventional diaphragm type pressure regulator available commercially from any number of suppliers. However, a preferred compact poppet type regulator is illustrated in FIG. 5. This regulator is of a modular design that may be "plugged" into a bore in a control valve body, as, for example, into the body 62 of FIG. 1. As a consequence of this modulator construction the regulator 16 may easily be installed and removed from the valve body for purposes of replacement or service.

The regulator valve module comprises the regulator valve body 200, a valve spool 205, a valve spool biasing spring 206, a pressure setting adjustment cap 207, and a pair of spring cups 208, 209 retaining a pressure setting adjustment spring 210.

The regulator valve body 200 is adapted to be fitted into a bore 201 of the housing body 62. The bore 201 is intersected and in fluid communication with an inlet air passage 203 of the housing 62 and an outlet air passage 204. The outlet passage 204 intersects the bottom of the bore 201, while the passage 203 intersects the side wall of the bore.

The regulator valve body 200 is generally shaped as a sleeve upon which there are two radially extending flanges. One of the flanges 211 is hexagonally shaped and is adapted to seat within a parallel sided recess 212 and in the top surface of the housing 62 to prevent rotation and to be secured therein against axial motion by a retainer clip 213. The clip 213 is in turn secured to the housing by a screw 214. The other flange 216 extends radially outwardly from the sleeve near the top and is threaded as at 217 for reception of the threaded bore 218 in the adjusting cap 207. Near its lower end, the valve body has a series of apertures 220 extending therethrough in the horizontal plane of the inlet air passage 203. These apertures connect the inlet air passage 203 to the interior of the sleeve.

The interior of the body 200 is stepped so as to define a large diameter bore 225 at the upper end and a smaller diameter bore 226 at the lower end. This lower diameter bore 226 acts as a cylinder within which the valve spool 205 is movable. The valve spool 205 is generally tubular in shape and has a stepped internal bore 227 which extends axially through the spool and terminates in a hexagonally shaped opening 236 at the bottom of the spool. At its upper end the spool terminates in an outwardly extending flange 228 which is generally square except for four arcuate corners which cooperate with the bore 225. From the upper surface of the flange 228 there protrudes a semicircular torus 229. This torus or protrusion from the top surface of the sleeve cooperates with the bottom surface of the spring cup 208.

The lowermost outer end of the valve spool terminates in a threaded end section 230. A valve seat 231, preferably made of a slightly resilient material, as for example an acetal polymer, is retained on the spool by a nut 237 threaded over the end 230 of the spool. This seat has a radially extending flange the top surface of which is spherically tapered as at 232 to provide a self-aligning resilient valve element for the piston. This tapered seat cooperates with the bottom inside edge 233 of the valve body to form the tapered poppet seal 234 of the valve.

Intermediate its ends, the valve spool is fitted with a low friction lip seal 235 cooperating with the bore 226. The bore 226 and the edge 233 are approximately the same diameter to negate any force effect from the inlet air pressure. The spool diameter 238 immediately adjacent the lip seal 235 operates in conjunction with the arcuate corners of the flange 228 cooperating respectively with the bores 225, 226 to generally align the valve seat 231 with respect to the edge 233 in a zone within which precise self-alignment of the poppet seal 234 can reliably take place. The spool is biased in the absence of force from the adjustment spring 210 to a position in which the poppet seal 234 is closed by the light biasing spring 206.

Adjustment of the valve is effected by compression of the spring 210. At its upper end, the spring 210 fits around the hub 241 of the cup 209. This latter cup is free to self-align as a consequence of its being supported solely by a ball 243 upon which it is free to rock. The ball in turn is fitted into a portion of a semi-spherical recess 244 in the cap 207, and in a similarly shaped recess 245 in the top surface of the spring cup. At is lower end the spring 210 fits around the hub 240 of the spring cup 208 which is preferably made of a slightly resilient material, as for example an acetal polymer. The spring cup 208 cooperates with the protrusion 229 on the spool 205 to form the flat poppet seal 239. In the preferred embodiment the cups 208, 209 are identical.

The force imposed by the spring 210 on the cup 208 is constrained to be central to the cup by the upper ball support 245. This central force acting in conjunction with a pivotal reaction at any point of the protrusion 229 causes the cup 208 to be self-aligning in parallel relation to the contact edge of the protrusion 229.

In operation, air is supplied through the air inlet passage 203 of the housing 62, through the apertures 220 in the sleeve, into the interior chamber 246 of the valve body. If the air pressure in the outlet passage 204 multiplied by the area of the poppet seal is less than the net spring force applied to the spool, the spring force opens the poppet seal 234 allowing inlet air to enter the passage 204. In the event that the air pressure in the passage 204 multiplied by the area of the poppet seal 239 is greater than the force applied by the spring 210, the outlet pressure is reduced by unseating the spring cup 208 from the protrusion 229, thus allowing outlet air to vent through the upper end of the valve body and through the exhaust port 250 of the sleeve to atmosphere. The valving areas are preferably selected so that the outlet venting pressure is slightly higher than the outlet filling pressure to avoid valving instability or chatter.

In order to increase the regulated air pressure in the outlet passage 204, the compression of the spring 210 is increased so that a greater outlet air pressure force is required to close the poppet seal 234. Alternatively, to reduce the regulated air pressure in the outlet passage 204, the compression of the spring 210 is reduced so that a lesser outlet air pressure force is required to open the poppet seal 239 allowing outlet air to escape to atmosphere through the chamber 249 in the upper end of the valve body.

The primary advantage of this regulating valve resides in its provision of self-aligning poppet valves operating in cooperation with a moving spool which has minimal resistance to axial displacement as a consequence of being fitted with only one dynamic pressure retaining lip seal 235. The acetal polymer tapered valve seat 231 at the bottom of the valve spool serves to self-align the poppet seal 234 as well as providing slight resilience which compensates for minor irregularities in the elements comprising that poppet seal. Simmilarly, the acetal polymer spring cup 208 acts in cooperation with the centrally supported spring 210 and the protrusion 229 to self-align the poppet seal 239 as well as providing slight resilience which compensates for minor irregularities in the elements comprising that poppet seal.

While I have described a preferred embodiment of my invention, persons skilled in the art to which this invention pertains will readily appreciate changes and modifications which may be made without departing from the spirit of my invention. Therefore, I do not intend to be limited except by the scope of the following appended claims.

Having described my invention, I claim:

1. Apparatus for controlling the transmission of fluid pressure to a double-acting fluid motor cylinder for driving a reciprocating piston therein, comprising directional control valve means, fluid pressure supply means, first and second pilot operating valves for transmitting fluid pressure from said pressure supply means alternately to opposite ends of said directional control valve means, said directional control valve means being operable to alternately supply fluid pressure to one end of said motor cylinder while exhausting fluid from the opposite end of said motor cylinder, said directional control valve means comprising a valve body having a pair of stepped bores therein, each of said stepped bores being intersected and in fluid communication with an exhaust channel, a pressure supply channel and a motor supply channel, a valve spool slidably mounted within each of said stepped bores, said spools each having two poppet sealing elements thereon operable with respect to said motor supply channel to alternatively connect said motor supply channel to said exhaust channel and supply channel, means including a pair of chokes operable to assist in axially positioning each of said spools in said stepped bores, one of said pair of chokes being a continuously operable choke of moderate restriction between said spool and said stepped bore, the other of said pair of chokes being an intermittently operable choke of high restriction between said spool and said stepped bore, and a spring in each of said bores operable to bias said spools axially toward one end position in said stepped bores.

2. The apparatus of claim 1 in which said stepped bores are each defined in part by a sleeve fixedly mounted in said valve body, said sleeves having a portion of one of said chokes formed thereon.

3. The apparatus of claim 2 in which one of said two poppet sealing elements of said spool includes a resilient valve seal disposed on each of said valve spools, said sleeves each having a sealing element formed thereon and cooperable with said resilient seals on said spools to effect a pressure seal between said spools and stepped bores in one end position of said spools in said bores.

4. The apparatus of claim 1 which further includes a resilient valve seat disposed in each of said stepped bores, one of said two poppet sealing elements of each of said spools comprising a sealing element cooperable with said resilient seals of said stepped bores to effect a pressure seal between said spools and stepped bores in one end position of said spools in said bores.

* * * * *

UNITED STATES PATENT AND TRADEMARK OFFICE

CERTIFICATE OF CORRECTION

PATENT NO. : 3,943,823

DATED : March 16, 1976

INVENTOR(S) : Simon Z. Tamny

It is certified that error appears in the above-identified patent and that said Letters Patent are hereby corrected as shown below:

Col. 2, line 18, "three-ways" should be -- three-way --
Col. 2, line 44, "contamination" should be -- combination --
Col. 3, line 44, "invention" should be -- inventive --
Col. 4, line 58, "pot" should be --port --
Col. 5, line 36, "spring 41" should be -- spring 40 --
Col. 5, line 57, " 107" " should be -- 107' --
Col. 7, line 33 "means" should be -- channel --
Col. 8, line 17 " 107" " should be -- 107' --
Col. 8, line 20 "power" should be -- port --
Col. 8, line 24 " 72" " should be -- 72' --
Col. 9, line 31 "pressue" should be -- pressure --
Col. 14, line 8, after "212" the word "and" should be deleted
Col. 14, line 67, "at is" should be -- at its --
Col. 15, line 16, after "seal" the number -- 234 -- should be inserted.
Col. 15, line 49, "simmilarly" should be --similarly --

Signed and Sealed this twenty-second Day of June 1976

[SEAL]

Attest:

RUTH C. MASON
*Attesting Officer*

C. MARSHALL DANN
*Commissioner of Patents and Trademarks*